United States Patent [19]

Butot

[11] Patent Number: 4,812,609

[45] Date of Patent: Mar. 14, 1989

[54] DEVICE FOR HEATING A PRODUCT BY MEANS OF DIELECTRIC HIGH FREQUENCY HEATING

[75] Inventor: Lucas A. Butot, Amsterdam, Netherlands

[73] Assignee: I.K. International B.V., Netherlands

[21] Appl. No.: 24,064

[22] Filed: Mar. 10, 1987

[30] Foreign Application Priority Data

Nov. 21, 1986 [NL] Netherlands ..... 8602956

[51] Int. Cl.[4] ..... H05B 6/54

[52] U.S. Cl. ..... 219/10.81; 219/10.67; 99/358

[58] Field of Search ..... 219/10.81, 10.75, 10.67, 219/10.55 E; 99/451, 358, DIG. 14; 426/234

[56] References Cited

U.S. PATENT DOCUMENTS

| | | | |
|---|---|---|---|
| 2,474,420 | 6/1949 | Himmel | 219/10.81 X |
| 2,512,311 | 6/1950 | Davis | 219/10.81 X |
| 2,542,589 | 2/1951 | Stanton et al. | 219/10.81 |
| 3,082,710 | 3/1963 | Holland | 219/10.81 X |
| 3,591,751 | 7/1971 | Goltsos | 219/10.55 E |
| 3,866,255 | 2/1975 | Serota | 219/10.81 X |
| 4,296,298 | 10/1981 | MacMaster et al. | 219/10.81 |
| 4,303,820 | 12/1981 | Stottmann et al. | 219/10.81 |
| 4,522,834 | 6/1985 | Miyahara | 219/10.81 |

*Primary Examiner*—Philip H. Leung

*Attorney, Agent, or Firm*—Lowe, Price, LeBlanc, Becker & Shur

[57] ABSTRACT

A heating device, particularly for food products, includes a housing containing at least a pair of electrodes connected to supply dielectric high frequency heating. The product, contained within a tray, is positioned between the electrodes being connected to a high frequency alternating current. At least one electrode on which the tray with product can be placed may include a number of rod-shaped electrodes. In another embodiment, one or both electrodes are positionable in the tray interior in intimate contact with the product.

4 Claims, 3 Drawing Sheets

DEVICE FOR HEATING A PRODUCT BY MEANS OF DIELECTRIC HIGH FREQUENCY HEATING

The invention relates to a device for heating a product, in particular a food product, by means of dielectric high frequency heating, said device comprising a housing containing at least partially opposite positioned electrodes so that between these a product can be positioned being present in a tray, said electrodes being connected to a high frequency alternating current.

In case of the known devices the electrodes are having substantially the shape of a plate and the working of such devices is satisfying when the product to be heated is having a more or less homogeneous structure. Difficulties arise, however, when the latter is not the case e.g. when it is aimed to boil potatoes emerged in water till they are in the desired condition.

The object of the invention is to remove this disadvantage and to that end it is provided that at least that electrode on which the tray with product can be placed is composed of a number of rod shaped electrodes.

By this electric leakage fields can be generated by which a rather equal dividing is obtained of the delivered energy over the volume of the product in the tray. It has appeared too that when boiling e.g. potatoes these are heated from the inside because of which shorter preparation periods can be realized so that the taste, the food value and the vitamin contents can be maintained.

According to a feature of the invention, the rod shaped electrodes can be positioned parallel to and spaced from each other.

In particular it can be provided that also the opposite positioned electrode is composed of a number of rod shaped electrodes.

A still better dividing of the electric leakage fields can be obtained when between both electrodes an earth electrode is positioned.

According to an embodiment of the invention an upper electrode can be mainly plate-shaped and can be positioned in the tray in which the product to be heated is present, in which case the tray is standing on a lower electrode.

In this way the air gap between the upper electrode and the product can be made minimum or can be reduced till zero when the upper electrode is emerged in the product to be heated, as e.g. in the water in the tray.

In this case the upper electrode, which is substantially plate-shaped, can be provided with openings through which vapour bubbles can pass so that accumulation of bubbles below the electrode is prevented.

In a simple way the plate-shaped electrode can be provided with some upwardly and outwardly extending elements by which the electrode can be supported by the tray, said electrode being provided with an outwardly extending contact by which it can be brought into contact with a terminal connected to the high frequency tension source when the tray is shifted into the housing.

So the electrode is brought into the housing and is removed from it together with the tray so that the electrode can be cleaned when this is necessary. Because the electrode is supported by the rim of the tray by means of the upwardly and outwardly extending elements, the electrode can be emerged in the water in the tray if this is desired.

According to a further embodiment of the invention it can also be provided that both electrodes are symmetrically positioned in respect of each other and each are extending obliquely upwardly and outwardly from a bottom surface and at the highest point lying near a side wall are joining a substantially vertical portion.

It has appeared that by this a homogeneous dielectric field between the electrodes can be obtained. Further the shape of the tray in which the product to be heated is present, can be adapted to the shape of the electrodes so that the tray will be in the right position in respect of the electrodes.

The invention will be further elucidated by means of embodiments shown in the drawing, in which:

FIG. 1 schematically shows a plan view of a device according to the invention;

FIG. 2 shows an elevation of the device of FIG. 1 with some parts removed and with a tray positioned in the device;

FIG. 3 schematically shows a cross-section along the line III—III of FIG. 2;

Figure 7:
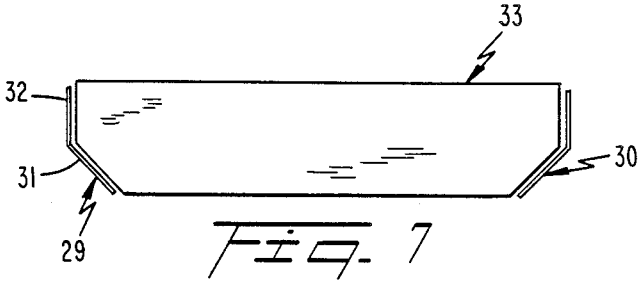
Figure 8:
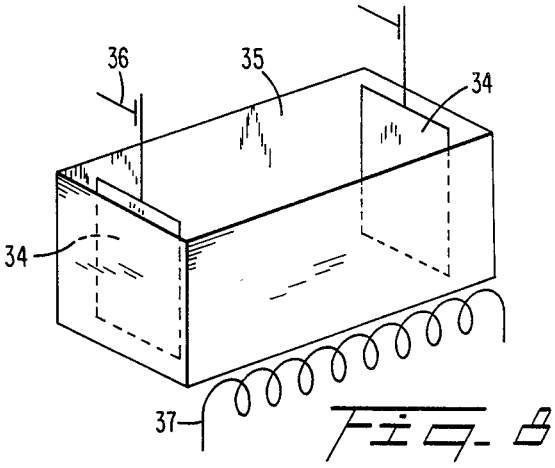

FIG. 7 schematically shows an elevation of a part of a device with another arrangement of the electrodes; and FIG. 8 schematically shows a perspective view of a part of still another embodiment of a device according to the invention.

Figure 1:
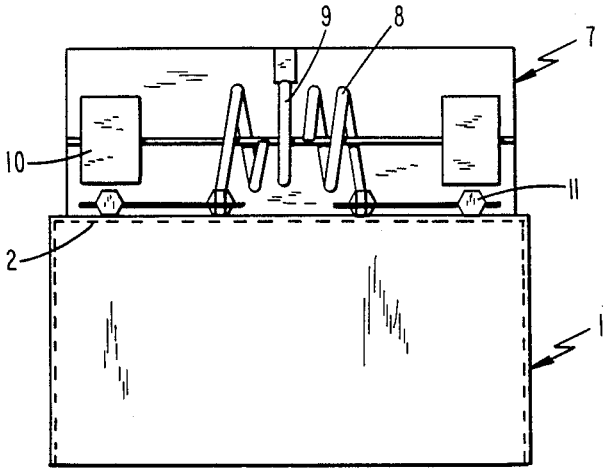
Figure 2:
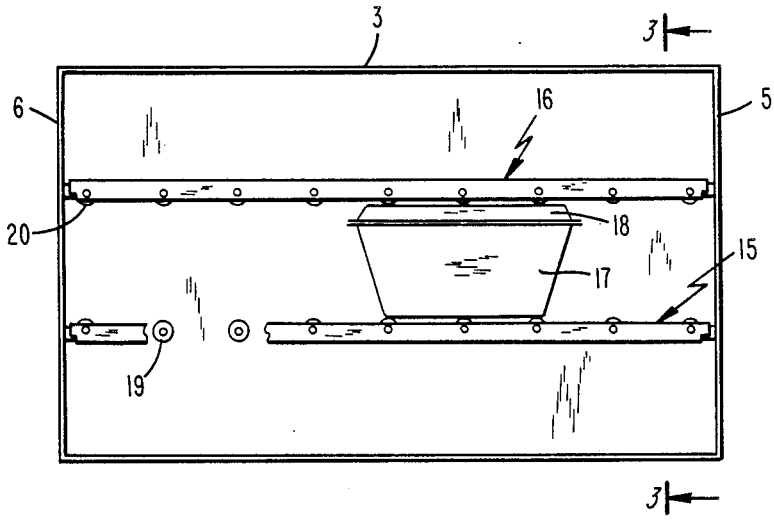
Figure 3:
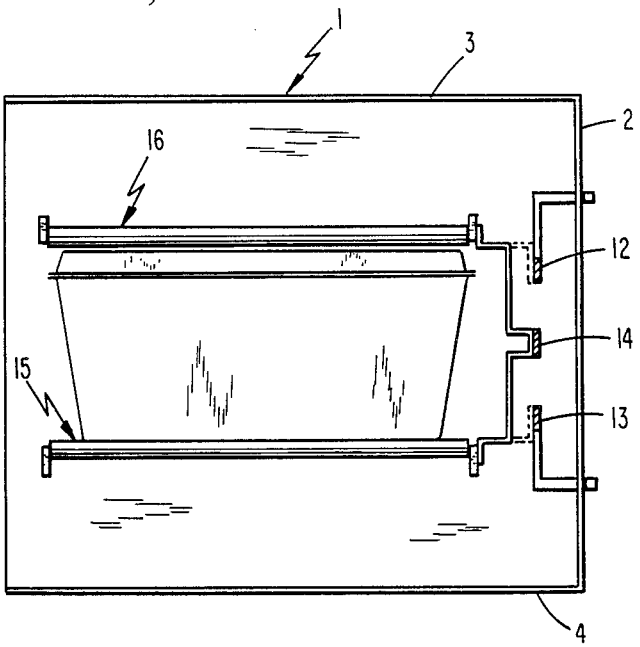

The device shown in the FIGS. 1–3 comprises a housing 1 consisting of the back wall 2, the upper wall 3, the bottom wall 4 and the side walls 5 and 6. As appears in particular from FIG. 3 one side of the housing 1 is open but it is obvious that this opening will be closed by a door which is not shown.

On the backwall of the housing 1 the apparatus 7 is mounted taking care for the high frequency alternating current and substantially comprising the coil 8, the coupling loop 9 and the tuning sleeve 10.

The connection between the coil 8 and the contacts 12 and 13 provided inside the housing 1 is obtained by means of insulators 11. In case of the shown embodiment still an earth strip 14 is provided in the housing.

The high frequency alternating current is supplied to the lower electrode 15 on the one side and to the upper electrode 16 on the other side. The product to be heated can be positioned between said electrodes, said product being present in the tray 17 which is covered by the lid 18.

The lower electrode 15 is composed of a number of rod shaped electrodes 19 and the upper electrode 16 from a number of rod shaped electrodes 20.

As in particular appears from FIG. 3 the lower rod shaped electrodes 19 are connected to the contact 13 on the one side and to the earth strip 14 on the other side, the upper rod shaped electrodes 20 being connected to the contact 12 on the one side and to the earth strip 14 on the other side.

Figure 4:
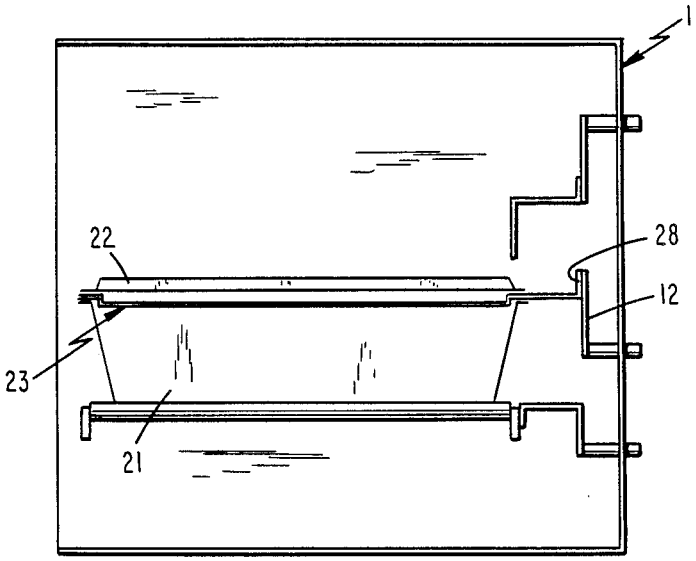
FIG. 4 shows a cross-section according to FIG. 3 but of a modified embodiment of the device.
Figure 5:
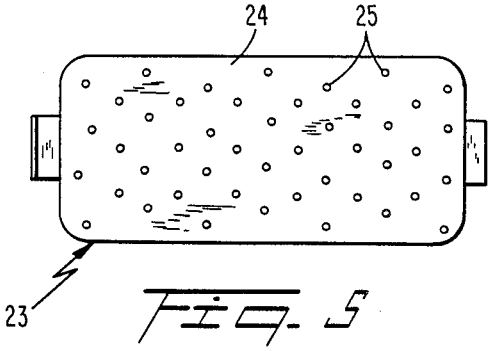
FIG. 5 shows a plan-view of an electrode as this is applied in case of the embodiment according to FIG. 4.
Figure 6:
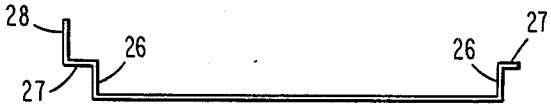
FIG. 6 shows a side view of the electrode of FIG. 5.

The FIGS. 4, 5 and 6 are showing the possibility to provide an electrode 23 in a tray 21 which is covered by the lid 22 and can have the shape as this is shown in the FIG. 5 and 6.

The electrodes 23 substantially consist of the plate 24 with in it the openings 25 and being provided with upwardly extending elements 26 which at the ends are provided with bent portions 27 by which the electrode can be supported by the tray 21. The one bent portion 27 again is provided with a bent portion 28 which, as appears in particular from FIG. 4, can be brought into contact with the contact 12 when the tray 21 is positioned in the housing 1. In case of the embodiment according to FIG. 7 both electrodes 29 en 30 are having a bent shape comprising the portions 31 and 32. The tray 33 which is used is having a shape adapted to the electrodes.

FIG. 8 is showing the possibility to have two electrodes 34 positioned into a tray 35, said tray e.g. being filled with oil. The electrodes 34 are connected with the tray 35 in an insulating way and are contacting terminals 36 when the tray is positioned in the housing, not shown.

Below the tray 35 now there are positioned either electrical heated elements 37 or gas burners, not shown, so that the device can be used as well for dielectric high frequency heating as for normal heating or for simultaneously heating in both ways. By this the field of use of the device is enormously enlarged.

It is thought that the invention and its advantages can be understood from the foregoing description and it is obvious that various changes may be made in the forms, construction and arrangement of the parts without departing from the spirit and scope of the invention, the devices hereinbefore described and illustrated in the drawings being merely preferred embodiments thereof.

We claim:

1. A device for heating a product contained within a tray, comprising:

a housing having a housing wall and a housing interior;

at least one contact projecting into the housing interior through the housing wall;

at least first and second electrodes and means for connecting said electrodes to a high frequency alternating current supplied to the electrodes through said at least one contact; and means for mounting at least one of the first and second electrodes such that in a heating position said at least one of the first and second electrodes extend into the tray interior into intimate contact with the product, and wherein said at least one of the first and second electrodes includes element means for providing electrical connection between said at least one of the first and second electrodes and the contact when the tray containing said at least one of the first and second electrodes is positioned in the housing interior at a predetermined position, wherein said first electrode is plate shaped and includes peripheral portions defining a lip adapted to engage an upper peripheral edge of the tray and wherein a major portion of said first electrode extends below the lip in the direction of the tray bottom.

2. The heating device of claim 1, wherein said lip is defined by bent portions supported by the upper peripheral edge of the tray and wherein one bent portion is provided with an upwardly extending portion functioning as said element means for contact with the contact when the tray is positioned on the second electrode mounted below said contact to the housing wall.

3. The heating device of claim 1, wherein said first electrode plate is provided with openings disposed substantially uniformly across the plate surface.

4. A device for heating a food product comprising:

a housing;

a tray positionable within the housing and adapted to contain said food product, said tray having an exterior surface, said exterior surface of said tray has first and second surface portions defining sides of said tray and wherein said first and second surface portions form an angle with respect to each other;

electrode means mounted within the housing and connected to a source of high frequency alternating current to transmit dielectric high frequency energy from said electrode means directly to the tray through its exterior surface in contact with the electrode means;

wherein said electrode means includes at least a pair of plate-shaped electrodes having opposing surfaces facing each other to define a support for supporting said sides of said tray within the housing, and wherein the opposing surface of each of said electrode is adapted to contact the tray sides with said surfaces being substantially identical to said first and second surface portions in their angular relationship, such that a major portion of each opposing surface is in contact with the tray exterior surface to transmit dielectric high frequency energy directly to said tray.

* * * * *